United States Patent [19]

Schoenheit et al.

[11] Patent Number: 4,860,997

[45] Date of Patent: Aug. 29, 1989

[54] SLAT FENCE WITH RETAINER WIRE CONSTRUCTION

[75] Inventors: Joseph W. Schoenheit, Portland; Stephen E. Weisensee, West Linn, both of Oreg.

[73] Assignee: Pacific Fence and Wire Company, Clackamas, Oreg.

[21] Appl. No.: 170,406

[22] Filed: Mar. 18, 1988

[51] Int. Cl.[4] ..... B21F 27/00

[52] U.S. Cl. ..... 256/34; 256/12.5; 256/35; 245/11

[58] Field of Search ..... 256/34, 12.5, 35; 245/11

[56] References Cited

U.S. PATENT DOCUMENTS

| | | | |
|---|---|---|---|
| 53,616 | 4/1866 | Hillis . | |
| 79,121 | 6/1868 | Hillis . | |
| 107,020 | 9/1870 | Fales . | |
| 110,234 | 12/1870 | Hillis . | |
| 328,392 | 10/1885 | Dudley . | |
| 960,751 | 6/1910 | White | 256/34 X |
| 1,846,606 | 2/1932 | Maxcy | 256/34 |
| 2,753,156 | 2/1954 | Rieger . | |
| 3,892,056 | 7/1975 | Mann . | |
| 3,988,009 | 10/1976 | Mann . | |
| 4,085,954 | 4/1978 | Thompson . | |
| 4,512,556 | 4/1985 | Meglino . | |
| 4,570,906 | 2/1986 | Walden . | |
| 4,623,127 | 11/1986 | Wier . | |

FOREIGN PATENT DOCUMENTS

| | | | |
|---|---|---|---|
| 269764 | 8/1965 | Australia | 256/12.5 |
| 1155583 | 10/1963 | Fed. Rep. of Germany | 256/34 |

*Primary Examiner*—Andrew V. Kundrat
*Attorney, Agent, or Firm*—Kolisch, Hartwell & Dickinson

[57] ABSTRACT

A slat assembly for insertion in a chain link fence includes a plurality of elongate, first slat members which are interwoven between vertically consecutive links of the fence. The first slat members rest on a second slat member which is interwoven between horizontlly consecutive lower links in the fence. A flexible retainer is constructed and arranged to be received in apertures formed in the first slat members. The retainer has terminating means located at the ends thereof for securing the retainer to the slats.

9 Claims, 1 Drawing Sheet

SLAT FENCE WITH RETAINER WIRE CONSTRUCTION

BACKGROUND AND SUMMARY OF THE INVENTION

The instant invention relates to fences, and particularly to a chain link fence having privacy slats inserted therein and a retainer for maintaining the slats in the fence.

The chain link fence has particular utility because it is a relatively inexpensive structure to install and may be erected in a relatively short period of time. However, by its very nature it does not provide privacy because of the open mesh construction of the chain link.

The insertion of slats into the links of a chain link fence is one means of providing privacy behind the fence. Slats formed of various materials have been used as inserts in a chain link fence. Wooden slats are well known, as are a variety of plastomer slats. Plastomer slats are disclosed in U.S. Pat. Nos. 4,085,954, 4,512,556, and 4,570,906.

One of the frequent problems associated with slat assemblies in chain link fence, is the removal of the slats by vandals, or the eventual natural deterioration of the slat material, which may cause a portion of a slat to become disloged, thereby leaving a gap in the fence.

Various forms of retaining mechanisms have been proposed to prevent the removal of slats by vandals and to maintain a uniform apparatus of the slat in spite of natural deterioration. The first two-mentioned patents above both provide retaining mechanisms. However, known retaining mechanisms are somewhat rigid and to date, have required somewhat complicated installation procedures.

An object of the instant invention is to provide a slat assembly which will hold the privacy slats in place in a chain link fence.

Another object of the instant invention is to provide a slat retainer which is flexible and therefore, easily manipulable.

A further object of the instant invention is to provide a fence assembly having a retainer which allows removal and replacement of less than the totality of the slats in the assembly.

Another object of the instant invention is to provide a slat assembly which is inexpensive to manufacture, easy to install and which does not detract from the aesthetic appearance of the fence.

The slat assembly of the invention is intended for insertion in a chain link fence and includes a plurality of elongate slat members which are predimensioned to be interwoven between vertically consecutive links of the fence. Each slat member has opposed, spaced apart, substantially planar faces which are integrally formed with opposed, spaced apart, curved edges which extend between the faces. A pair of aligned apertures are formed in each of the edges adjacent the upper end of each slat member. A flexible retainer is provided which is constructed and arranged to be received in the apertures and which has connecting means at the ends thereof for securing the retainer to the slats.

In one form of the invention the retainer includes a length of wire having a loop connector at at least one end thereof. In another form of the invention the retainer includes a section of tubing and joiners for joining the tubing sections together.

These and other objects and advantages of the invention will become more fully apparent as the description which follows is read in conjunction with the drawings.

DETAILED DESCRIPTION OF THE PREFERRED EMBODIMENTS

Figure 1:
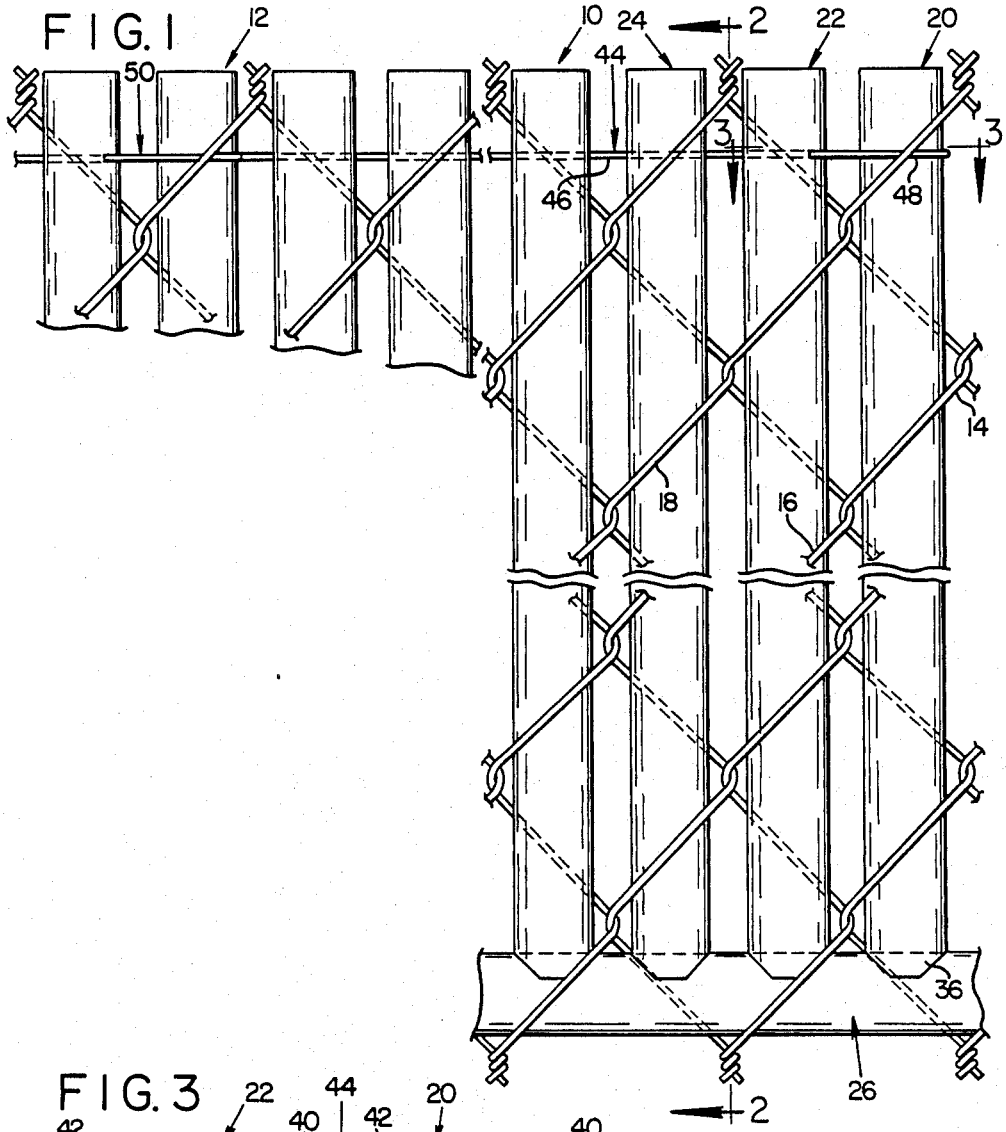
FIG. 1 is a side elevational view of a portion of a chain link fence, broken along its height, having the slat assembly of the instant invention installed therein.

Referring initially to FIG. 1, the slat assembly of the invention is shown generally at 10, and is depicted as installed in a chain link fence, a portion of which is shown generally at 12. Fence 12 includes a series of links, such as 14, 16, 18, etc. The links are arranged so as to form a series of vertical, parallel, consecutive rows and additionally, to form a series of horizontal, parallel, consecutive rows.

Slat assembly 10 is installed in fence 12 and includes first slat members, such as 20, 22 and 24, which are interwoven between vertically consecutive links of fence 12.

A second slat member 26 is interwoven between horizontally consecutive lower links in fence 12. First and second slat members are similarly constructed. Reffering now to slat 26 in FIG. 2 as an example, each slat has a pair opposed, spaced apart, substantially planar faces 28, 30 which are integrally formed with a pair of opposed, spaced apart curved edges 32, 34 to form a hollow slat member. The slat members are constructed of a thermal plastic resin material which may be formed by an extrusion process. This process enables the slats to be colored during the manufacturing process and to provide a finished product which has color extending throughout the structure.

The slat assembly is constructed so that the first slat members rest on the second slat members. To very briefly explain the interaction between first and second slat members, and now referring to FIGS. 1 and 2, the first slat members have at their lower ends, flanges, such as flanges 36 38, which are substantially planar and resilient and which are extensions of planar faces 28, 30, respectively. The flanges taper from the edges of the slat toward the mid-line thereof and are disposed about the exterior of the second slat member. Second slat members are initially inserted in the bottom most horizontally extending links along a length of fence. The vertically disposed slat members are then inserted with the flanges thereon disposed over the horizontally extending slat members. The details of this construction are disclosed in U.S. Pat. No. 4,570,906, which is incorporated herein by reference.

The slat members are dimensioned so that they substantially fill the area between the links of a chain link fence but are not so large as to render insertion into the links of the fence difficult.

Figure 2:
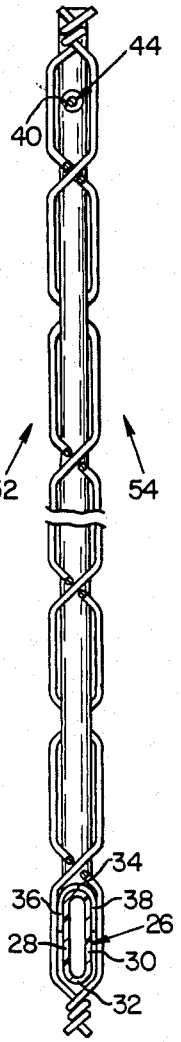
FIG. 2 is a cross section of the fence, taken generally along the line 2—2 of FIG. 1.
Figure 3:
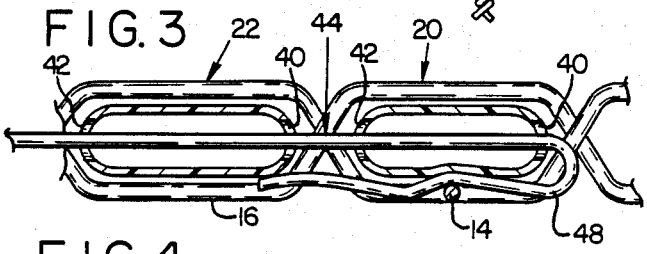
FIG. 3 is a top section view, taken generally along the line 3—3 of FIG. 1.

Referring now to FIGS. 2 and 3, the first slat members are constructed with a pair of opposed, aligned apertures 40, 42, formed in either edge of the slat. The apertures are located adjacent the upper end of each vertical, first slat member and positioned equadistant from the end of the slat. The apertures are operable to receive a flexible retainer, such as retainer 44, therein.

Retainer 44, in this embodiment, includes an elongate, flexible, resilient wire which has a trained portion 46 which extends through apertures 40, 42 in consecutively positioned slat members. Terminating means are disposed at the end of trained portion 46 and in this embodiment, take the form of a connecting loop 48 which is formed around slat 20 and under link 14. In some situations, it may be desirable to extend connecting loop 48 around the outside of a link however, this determination primarily depends upon the installer. Retainer 44 is sized to extend over several slats, and may be easily installed in six to eight slats. Another retainer, such as retainer 50 (FIG. 1) would be installed in subsequent slats. The free end of trained portion 46 may be inserted into aperture 40 to prevent it from becoming damaged.

The retainer is operable to maintain the slats in position in the fence and, with connecting loops 48 disposed on the non-public side 52 of the fence, make the removal of slats by an individual standing on the public side 54 of the fence quite difficult, because the retainers must be removed before a slat can be pulled free of the fence and the location of the connecting loops is not readily visible from the public side of the fence.

Figure 4:
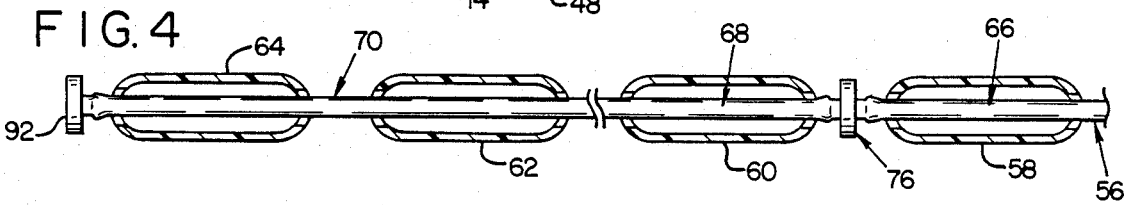
FIG. 4 is a top sectional view of a second form of the retainer of the invention, with the fence being deleted to clarify the construction.
Figure 5:
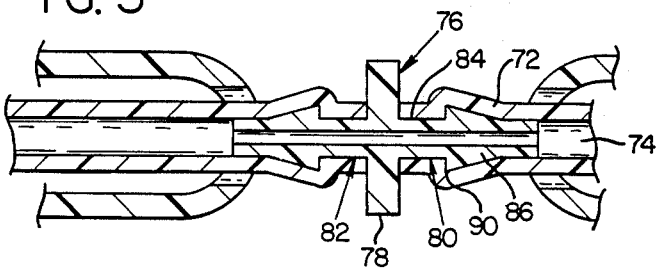
FIG. 5 is a greatly enlarged section through a joiner of the invention.

Referring now to FIGS. 4 and 5, a second form of the retainer of the invention is depicted. In this form of the invention a retainer 56 is disposed in a series of slats depicted at 58, 60, 62 and 64 which are constructed identically to those discussed in connection with FIGS. 1, 2 and 3. The fabric of the fence has been deleted from FIGS. 4 and 5 to clarify the drawings. Retainer 56 includes section of tubing, 66, 68 and 70.

Referring now to FIG. 5, in the preferred embodiment, the tubing section are hollow and include a side wall portion 72 and a hollow core 74. The tubing material may generally be formed of some synthetic resin material which is resistant to ultraviolet radiation, moisture, and temperature extremes. As in the case of retainers 44 and 50, retainer 56 is comprised of lengths of tubing which will extend over a number of slats. The tubing used in retainer 56 is flexible and resilient and may easily be threaded through apertures 40, 42 located in the slats.

The tubing sections are joined by means of joiners 76 which, in this embodiment, each include a disc 78. Although the disc is depicted as having a circular form, other geometric forms may also be used. Joiners 76 may be formed of a semi-rigid polymer material that has the environment resistant characteristics described in conjunction with the tubing material.

A pair of opposed nipples 80, 82 are located on either side of disc 78. Nipples 80, 82 are constructed and arranged to be insertable in core 74 of the tubing sections. Each nipple includes a cylindrical portion 84 and a distal portion 86. Distal portion 86 may be seen to include a truncated conical section which has its larger end 90 fixed to cylindrical portion 84. End 90 has a diameter slightly greater than that of cylindrical portion 84 and, with the side wall 72 of the tubing extending thereabout, acts to lock the tubing onto the joiner.

Terminating means in this embodiment take the form of an end piece joiner 92, which has had the nipple cut off of one side thereof, and serves to prevent drawing of retainer 56 from the apertures in the slats.

Thus, a slat assembly for use in a chain link fence and a retainer therefore has been disclosed. The retainer is suitable to prevent removal of slats from the chain link fence and is relatively inconspicuous when installed. The retainer is flexible and may be removed from a length of fence in order to remove and replace any damaged slats without having to remove an excessively long length of the retainer.

Although two forms of the invention have been disclosed herein, it should be appreciated that variations and modifications may be made thereto without departing from the spirit of the invention.

It is claimed and desired to secure as Letters Patent:

1. A slat assembly for insertion in a chain link fence comprising:

a plurality of elongate slat members predimensioned to be interwoven between vertically consecutive links of the fence, each slat member having opposed, spaced apart, substantially planar faces integrally formed with opposed, spaced apart, curved edges which extend between said faces, and having aligned apertures on each of the edges adjacent the upper end of each slat member; and a flexible retainer constructed and arranged to be received in said apertures which includes tubing sections and joiners for joining said tubing sections together and having terminating means at the ends thereof.

2. The assembly of claim 1 wherein said tubing is hollow and said joiners include a disc having nipples on either side thereof, said nipples being constructed and arranged to be insertable in said hollow tubing sections.

3. The assembly of claim 2 wherein said nipples include a cylindrical portion which is fixed to said disc and a distal portion having a substantially truncated conical shape, with the larger end of cone being fixed to said cylindrical portion and having a diameter greater than that of said cylindrical portion.

4. The assembly of claim 1 wherein said slat members each have a lower end from which extend a pair of substantially planar and resilient, spaced apart flanges which taper inwardly from said edges; and which further includes an elongate second slat member, having opposed, spaced apart, substantially planar faces integrally formed with opposed, spaced part, curved edges which extend between said faces, said second slat members being predimensioned to be interwoven between horizontal consecutive, lower links in the fence, and wherein said flanges are disposed about the exterior of said second slat members with said first mentioned slat members resting thereon.

5. A slat assembly for insertion in a chain link fence comprising;

a plurality of elongate first slat members, said first slat members predimensioned to be interwoven between vertically consecutive links of the fence, having opposed, spaced apart, substantially planar faces integrally formed with opposed, spaced apart, curved edges which extend between said faces, and having aligned apertures on each of the edges adjacent the upper end of each slat member, and which include a flange extending downward from said planar face at the lower end of said first slat member, said flange being tapered towards the middle thereof; and an elongate second slat member, having opposed, spaced apart, substantially planar faces integrally formed with opposed, spaced apart, curved edges which extend between said faces, said second slat members being predimensioned to be interwoven between horizontal consecutive, lower links in the fence, wherein said flanges of each first slat member are disposed about the exterior of said second slat members with said first mentioned slat members resting thereon; and a flexible retainer constructed and arranged to be received in said aperture, said retainer including hollow tubing sections and joiners for joining said tubing sections together, and having terminating means at the ends thereof.

6. The assembly of claim 5 wherein said joiners include a disc having nipples integrally formed therewith on either side thereof, wherein said nipples include a cylindrical portion which is fixed to said disc and a distal portion having a substantially truncated conical shape, with the larger end of the cone being fixed to said cylindrical portion and having a diameter greater than that of said cylindrical portion.

7. The assembly of claim 5 which includes an end piece which is insertable in said hollow tubing to secure said retainer to the slats.

8. A slat assembly for insertion in a chain link fence comprising:

a plurality of elongate slat members predimensioned to be interwoven between vertically consecutive links of the fence, each slat member having opposed, spaced apart, substantially planar faces integrally formed with opposed, spaced apart, curved edges which extend between said faces, and having aligned apertures on each of the edges adjacent the upper end of each slat member; and a flexible retainer constructed and arranged to be received in said apertures, said retainer including a length of wire, arranged in a substantially straight line through said apertures, said wire having a loop connector at the ends thereof for securing said retainer to the fence.

9. The assembly of claim 8 wherein said slat members each have a lower end from which extend a pair of substantially planar and resilient, spaced apart flanges which taper inwardly from said edges; and which further includes an elongate second salt member, having opposed, spaced apart, substantially planar faces integrally formed with opposed, spaced apart, curved edges which extend between said faces, said second slat members being predimensioned to be interwoven between horizontal consecutive, lower links in the fence, and wherein said flanges are disposed about the exterior of said second slat members with said first mentioned slat members resting thereon.

* * * * *